United States Patent [19]

Solobay

[11] 4,436,983

[45] Mar. 13, 1984

[54] ELECTRIC WATER HEATER WITH UPWARDLY INCLINED ZIG-ZAG FLOW PATH

[76] Inventor: Leo A. Solobay, 410 Quebec Ave., Toronto, Canada, M6P 2V4

[21] Appl. No.: 455,087

[22] Filed: Jan. 3, 1983

Related U.S. Application Data

[63] Continuation of Ser. No. 242,952, Mar. 12, 1981, abandoned.

[51] Int. Cl.[3] ..... H05B 1/02; H05B 3/82; F24H 1/20

[52] U.S. Cl. ..... 219/306; 219/298; 219/308; 219/321; 219/341

[58] Field of Search ..... 219/296, 298, 299, 306, 219/307, 308, 309, 320, 321, 316, 341

[56] References Cited

U.S. PATENT DOCUMENTS

| | | | |
|---|---|---|---|
| 1,684,963 | 9/1928 | Luehrs | 219/306 X |
| 2,911,511 | 11/1959 | Megarry | 219/306 X |
| 3,348,019 | 10/1967 | Miller | 219/306 X |
| 3,523,180 | 8/1970 | Kennedy | 219/341 X |

FOREIGN PATENT DOCUMENTS

| | | | |
|---|---|---|---|
| 815015 | 3/1937 | France | 219/306 |
| 223294 | 10/1924 | United Kingdom | 219/306 |
| 439601 | 12/1935 | United Kingdom | 219/306 |
| 614803 | 12/1948 | United Kingdom | 219/306 |
| 1523763 | 9/1978 | United Kingdom | 219/306 |

*Primary Examiner*—A. Bartis

*Attorney, Agent, or Firm*—Robert F. Delbridge; Arne I. Fors

[57] ABSTRACT

An electric water heater has an inlet, an outlet and a series of consecutive pipe sections arranged in a zig-zag configuration through which water flows in passing from the inlet to the outlet. The zig-zag configuration is such that in use the pipe sections are one above the other in a common plane and each pipe section is inclined to the horizontal at an angle of 30–75 degrees such that a substantial upwards convection force is produced propelling the water from the inlet to the outlet. Each pipe section has a first end, second open end and a side wall opening adjacent the first end and is provided with a unitary tubular member adjacent the first end and having a lateral tubular extension communicating with the side wall opening of the pipe section. Each pipe section has an elongated electric immersion heater supported by the tubular member and extending into the pipe section from the first end. The lateral extension of the tubular member of the first section is connected to the water inlet. The second open end of each pipe section but the last is connected to the lateral extension of the tubular member on the next pipe section. The second open end of the last pipe section is connected to the water outlet. A sequencer is provided for sequentially energizing the heating elements beginning with the uppermost element.

8 Claims, 3 Drawing Figures

ELECTRIC WATER HEATER WITH UPWARDLY INCLINED ZIG-ZAG FLOW PATH

Figure 1:
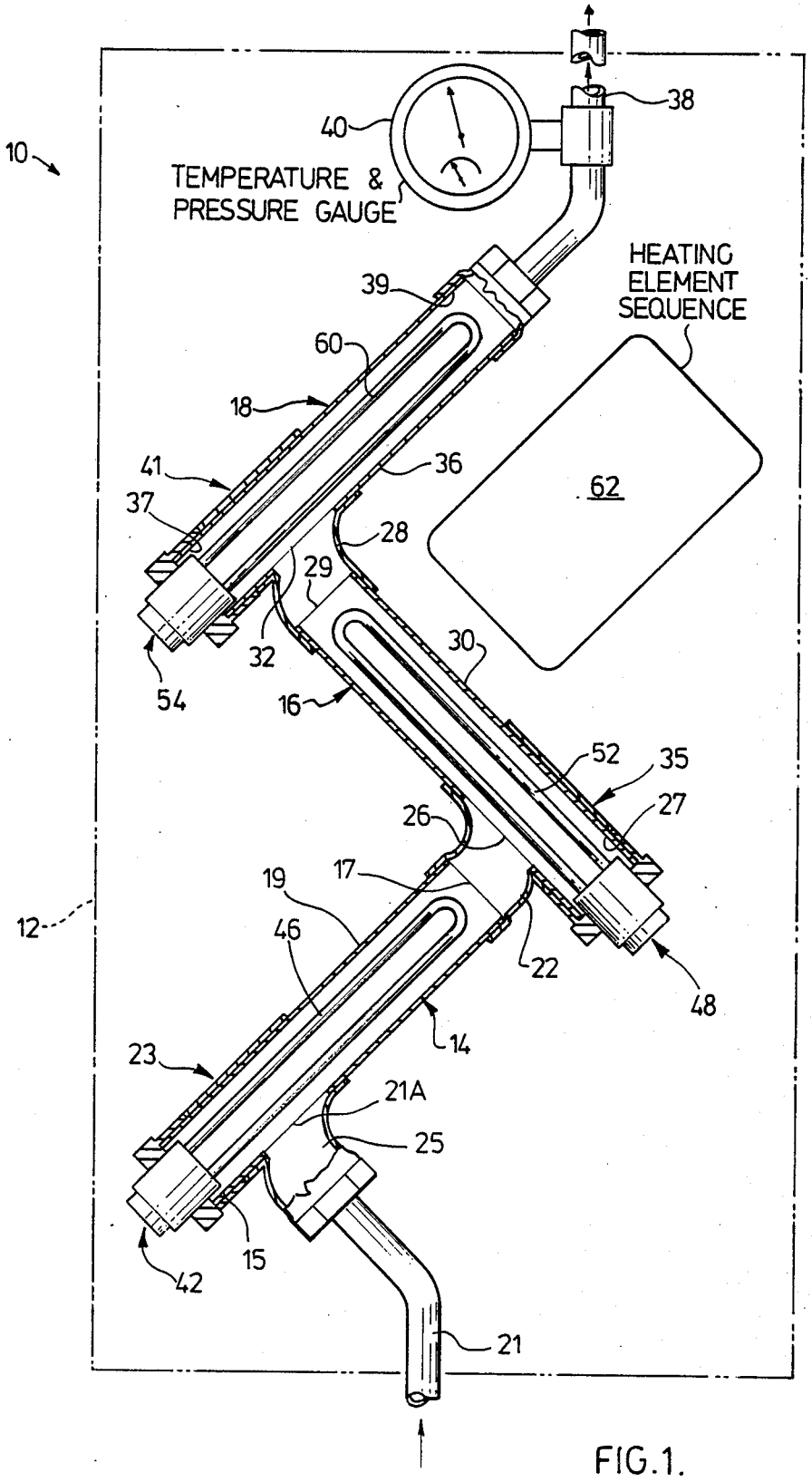

This is a continuation of application Ser. No. 242,952 filed Mar. 12, 1981, now abandoned.

This invention relates to electric water heaters.

Hot water is frequently used in the heating of buildings, for example by circulation through radiators or by using hot water to heat air which is then circulated to a desired area in the building. Hot water is of course also frequently required for use as such, for example in connection with personal or industrial washing facilities.

At the present time, it is becoming increasingly important to conserve energy and to minimize environmental pollution. Electric heating is very acceptable from an environmental point of view, but is inclined to be somewhat expensive compared to other forms of energy especially in connection with the heating of water.

It is known to heat water by means of an electric immersion heater in a water tank or in a pipe through which the water flows. In the former case, a large volume of water has to be heated in readiness for use and, since a hot water tank is almost inevitably imperfectly insulated, undesirable energy losses occur. In the latter case, the immersion heater has to be powerful in order to rapidly heat water flowing through the pipe. It is also known to arrange immersion heaters in a series of horizontal parallel pipe sections through which water is passed in sequence, so that water passing through the pipe sections is effectively heated. However, in either of these instances, a potentially dangerous situation arises if the circulating pump fails when the immersion or heaters are on, since water ceases to flow through the pipe or pipe sections and is consequently heated to a dangerously high temperature.

It is therefore an object of the present invention to provide an electric water heater which overcomes the above mentioned disadvantages.

According to the present invention, an electric water heater has an inlet, an outlet and a series of consecutive pipe sections in a zig-zag configuration through which water successively flows in passing from the inlet to the outlet, each pipe section having an electric immersion heater therein extending longitudinally of the pipe section and past which water passing through the pipe section flows, the zig-zag configuration being such that, when the heater is in use with the pipe sections one above the other, each pipe section is upwardly inclined to the horizontal such that water flows in an upwardly inclined direction through each pipe section.

With an electric heater in accordance with the invention, the specified zig-zag configuration of the pipe sections causes the heating of the water by the immersion heaters to produce a substantial upwards convection force producing upward flow of water through the heater from the inlet to the outlet. Thus, if a circulating pump fails while the immersion heaters are on, some water circulation still occurs by reason of the convection force to prevent the potentially dangerous overheating of water in the heater which would occur if there was no water flow.

Advantageously, each pipe section is upwardly inclined at an angle of at least about 30° C., preferably in the range of from about 30° to about 75° to the horizontal. Most preferably, each pipe section is upwardly inclined at an angle of about 45° to the horizontal. Further, the pipe sections are preferably disposed in a common vertical plane.

The pipe sections of a water heater in accordance with the present invention may be arranged in a very compact manner, and may be utilized in a new hot water installation or may replace an existing hot water heater in an existing installation.

In addition to being safe and compact, a water heater in accordance with the present invention may also be constructed in such a manner as to efficiently use electrical energy for water heating.

The water heater of the present invention is useful in heating systems in which hot water is supplied to radiators located in various positions in a building, or in heating systems in which hot water is used to heat air which is then supplied to various areas in a building. There are of course other possible uses for the water heater of the present invention such as use as a booster in a hot water supply to increase the temperature of water from a central hot water supply for use for a specific purpose such as a multiple shower stall, a commercial dishwasher or a sterilizing room in a hospital. The water heater may also be used as a booster at upper levels of high buildings such as hotels or office buildings where adequately hot water is required at such levels. Other uses may be in industrial situations to maintain a required hot water temperature in long runs of pipe sections.

Figure 2:
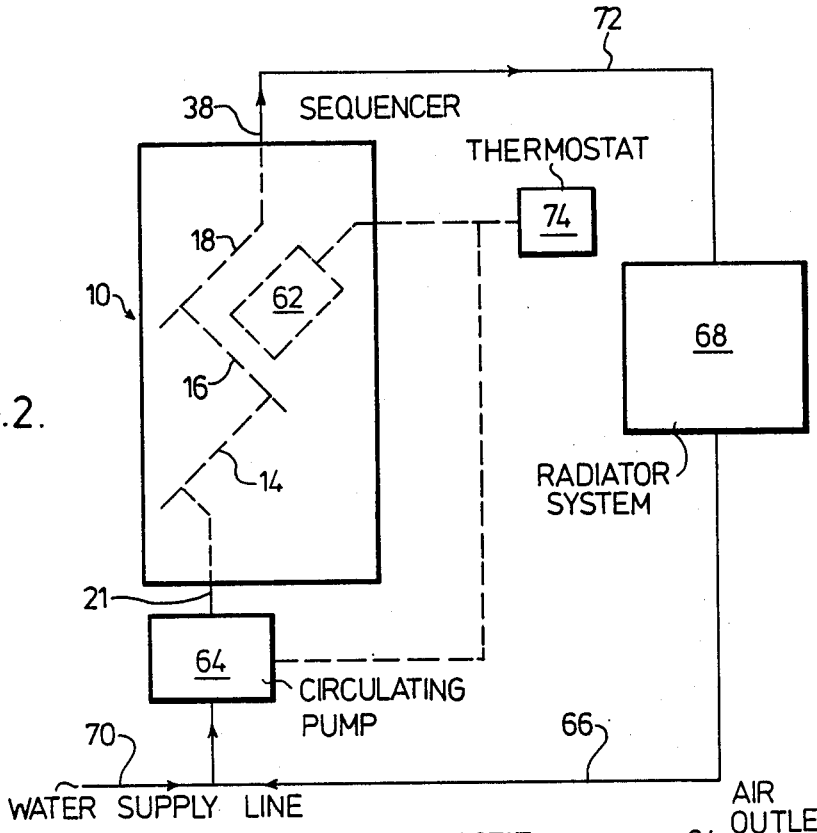
Figure 3:
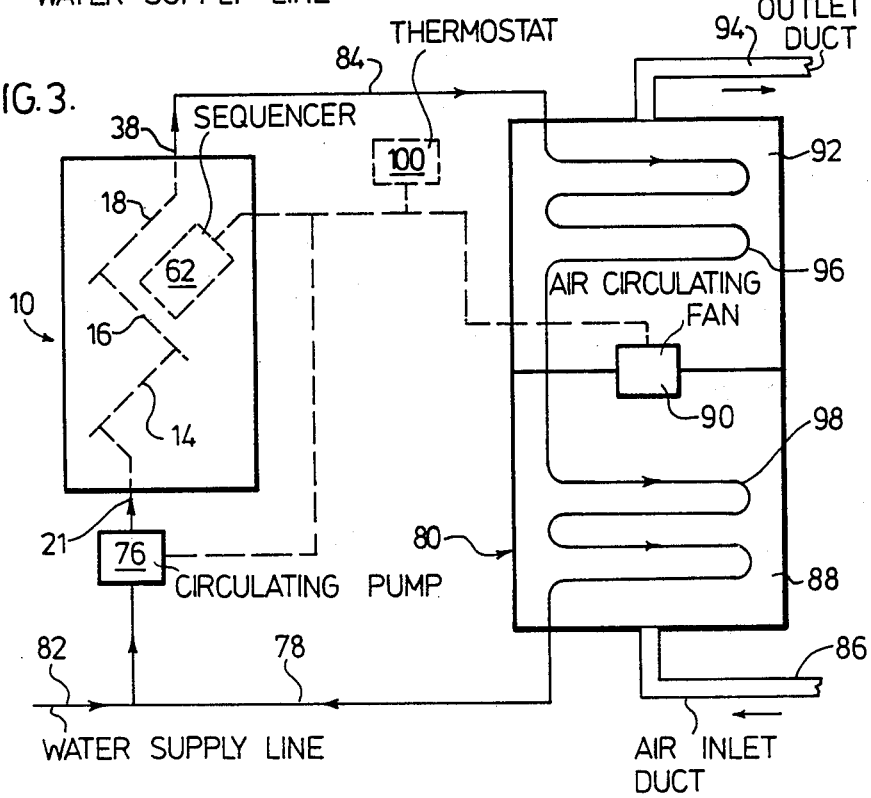

Embodiments of the present invention will now be described, by way of example, with reference to the accompanying drawings, of which:

FIG. 1 is a diagrammatic front view of a water heater in accordance with a preferred embodiment of the invention, FIG. 2 is a schematic view of a radiator heating system utilizing the water heater of FIG. 1, and FIG. 3 is a similar view showing a forced air circulation heating system utilizing the water heater of FIG. 1.

Referring to the accompanying drawings, FIG. 1 shows an electric water heater 10 in accordance with a preferred embodiment of the invention. The water heater 10 comprises a compact housing 12 containing three consecutive pipe sections 14, 16, 18. The first pipe section 14 is upwardly inclined at an angle of 45° to the horizontal, and has a first lower end 15, a second open upper end 17 and a side wall 19 with an opening 21 adjacent the first end 15. The pipe section 14 has a unitary tubular member 23 fitted thereon adjacent its first end 15, the tubular member 23 having a lateral tubular extension 25 communicating with the side wall opening 21A. The tubular extension 25 is connected to a heater inlet pipe 21.

The second pipe section 16 is located in the same vertical plane as the pipe section 14 and is inclined at an angle of 45° to the horizontal in the opposite direction to the first pipe section 14, with the second pipe section 16 therefore being perpendicular to the first pipe section 14. The second pipe section 16 has a first lower end 27, a second open upper end 29 and a side wall 30 with an opening 26 adjacent the first end 27. The pipe section 16 has a unitary tubular member 35 fitted thereon adjacent its first end 27, the tubular member 35 having a lateral tubular extension 22 communicating with the side wall opening 26. The tubular extension 22 is fitted over the open end 17 of the pipe section 14.

The third pipe section 18 is located in the same vertical plane as the first and second pipe sections 14, 16, and is upwardly inclined at an angle of 45° to the horizontal in the opposite direction to the second pipe section 16, with the third pipe section 18 therefore being perpendicular to the second pipe section 16 and parallel to the first pipe section 14. The three pipe sections 14, 16 and 18 are thus in a zig-zag configuration. The third pipe section 18 has a first lower end 37, a second open upper end 39 and a side wall 36 with an opening 32 adjacent the first end 37. The pipe section 16 has a unitary tubular member 41 fitted thereon adjacent the first end 37, the tubular member 41 having a lateral tubular extension 28 communicating with the side wall opening 32. The tubular extension 28 is fitted over the open end 29 of the pipe section 16.

The open end 39 of the third pipe section 18 is connected to a heater outlet pipe 38 which has a temperature and pressure gauge 40 connected thereto.

The first pipe section 14 contains an electric immersion heater 42 which is inserted into the pipe section from its lower end 15 and supported therein by the tubular member 23 so that the U-shaped heating element 46 of the immersion heater 42 extends within the pipe section 14 from the lower end 15 over substantially all the length of the pipe section 14 almost to its outlet 22. Similarly, the second pipe section 16 contains an electric immersion heater 48 which is inserted into the pipe section from its lower end 27 and supported therein by the tubular member 35 so that the U-shaped heating element 52 of the immersion heater 48 extends within the pipe section 16 from the lower end 27 over substantially all the length of the pipe section 16 almost to its outlet 28. Likewise, the third pipe section 18 contains an immersion heater 54 which is inserted into the pipe section from its lower end 37 and supported therein by the tubular member 41 so that the U-shaped heating element 60 of the immersion heater 54 extends within the pipe section 18 from the lower end 37 over substantially all the length of the pipe section 18 almost to its outlet 34.

The electric water heater also includes a sequencer 62 which is connected to the immersion heaters 42, 48, 54 by electric wiring which has been omitted from FIG. 1 for the sake of clarity. As will be clearly understood by a person skilled in the art, the sequencer 62 when actuated functions to cause electric current to be supplied first to the uppermost immersion heater 54, then after a predetermined interval to the middle immersion heater 48, and then after another predetermined interval to the lowermost immersion heater 42. Upon de-actuation, the sequencer 62 functions to switch off the immersion heaters in the reverse order, namely the lowermost immersion heater 42 first, the middle immersion heater 48 next, and finally the uppermost immersion heater 54. In this way, undesirably sudden changes in electrical line loads and in water temperatures in the water heater are avoided.

Preferably, the pipe sections 14, 16, 18 and inlet and outlet pipes 21, 38 of the water heater are of copper, with the upper portion of each pipe section being copper pipe of 0.5 inch (1.25 cm) or more diameter and said unitary tubular members 23, 35, 41 being a formed copper T-component which provides the lower lateral extension and an end connection for the immersion heater. Each immersion heater may be of standard design, for example 208–240 volts, 3–5 kilowatts, and a rating of about 20 amps. As mentioned earlier, the water heater of the present invention can be constructed in a compact manner, and with the arrangement described above, the housing 12 may conveniently have a length of 18 inches (46 cms), a width of 11 inches (28 cms) and a thickness of 3 inches (7.5 cms).

The specific possible uses of a water heater described above will be referred to later, but the general operation of the water heater will first be described. The water heater of FIG. 1 is installed with the orientation shown, that is to say with the pipe sections 14, 16, 18 in a vertical plane one above the other. Water is pumped into the lower inlet 21 and passes upwardly successively through the first pipe section 14, the middle pipe section 16 and the upper pipe section 18 from which water leaves the heater through the upper outlet 38.

When the sequencer 62 is actuated, the immersion heaters 54, 48, 42 are successively switched on, as previously mentioned, with the result that when all the heaters are switched on, the water is virtually continuously heated as it passes upwardly through the three zig-zag pipe sections 14, 16, 18 from the heater inlet 21 to the heater outlet 38. With the specific components previously described, water entering the lower inlet 21 at 65° F. (18° C.) may be heated to 77° F. (125° C.) by the second immersion heater 48, and to 200° F. (93° C.) by the third immersion heater 54.

In addition to the water circulating force provided by the circulating pump, it will readily be appreciated that the water heated provides a substantial water circulating force by convection due to he heating of the water by the immersion heaters in the upwardly inclined pipe sections 14, 16, 18. If the circulating pump fails while the immersion heaters are on, then the circulating force provided by convection is still present, so that some water circulation still takes place, thereby avoiding the possibility of water being overheated to an excessive temperature with potentially dangerous effects, such as might occur if the heaters were on with no circulation taking place.

Thus, the zig-zag configuration of pipe sections in accordance with the present invention provides a safe arrangement as well as a compact arrangement. Further, the zig-zag configuration of pipe sections with immersion heaters provides a safe, noiseless, non-polluting energy-efficient water heater. A person skilled in the art will now readily appreciate the variety of possible uses for the water heater of the present invention, for example as a replacement for water heaters in existing hot water systems or in the installation of new hot water systems.

FIG. 2 shows the use of a water heater in accordance with the present invention in a heating system for a home or other building which utilizes radiators positioned throughout the building. The system includes a circulating pump 64 which receives the water from a return line 66 from a radiator system 68 or from a fresh water supply line 70. The outlet of the pump 64 is connected to the lower inlet 21 of the water heater 10 whose upper outlet 38 is connected by a hot water line 72 to the radiator system 68.

A thermostat 74 at a suitable position in the building actuates both the circulating pump 64 and the sequencer 62 of the water heater 10 when the temperature falls below the preset value, thereby causing hot water to be supplied to the radiator system. If the circulating pump 64 fails while the water is being heated in the water heater 10, some water circulation will still occur owing to the previously described convection circulating forces in the water heater 10, thereby avoiding potentially dangerous overheating of water in the water heater 10. When the temperature in the building rises to the predetermined value, the thermostat 74 operates to switch off the circulating pump 64 and the immersion heaters in the water heater 10. The water heater 10 may clearly be used in more complex systems of this kind as a person skilled in the art will readily appreciate.

FIG. 3 shows the use of a water heater in accordance with the present invention in a heating system for a home or other building which utilizes forced air circulation. The system includes a circulating pump 76 which receives water from a return line 78 from a heat exchanger 80 or from a fresh water supply line 82. The output of the pump 76 is connected to the lower inlet 21 of the water heater 10, whose upper outlet 38 is connected by a hot water line 84 to the heat exchanger 80.

In the heat exchanger 80, cool air enters from an inlet duct 86 into a lower plenum chamber 88. The heat exchanger 80 also has an air circulating fan 90 which, when operated, circulates air from the lower plenum chamber 88 to an upper plenum chamber 92, from which air passes through a supply duct 94 to designated areas of the building. The hot water from the supply line 84 passes first through heat exchanger coils 96 in the upper plenum chamber 92, and then through heat exchanger coils 98 in the lower plenum chamber 88. From the lower heat exchanger coils 98, the water passes to the return line 78.

A thermostat 100 at a suitable position in the building actuates the circulating pump 76, the sequencer 62 of the heater 10 and the air circulating fan 90 when the temperature falls below the preset value, thereby causing hot water to be circulated through the upper and lower heat exchanger coils 96, 98, and also causing air to be circulated from the lower plenum chamber 88 to the upper plenum chamber 92 and thence to the supply duct 94. Thus, air in the lower and upper plenum chambers 88, 92 is heated and circulated by the fan 90 through the supply duct 94 to desired areas of the building. It will be noted that, as described in connection with FIG. 2, water will still be circulated by convection in the heater 10 if the circulating pump 76 fails while water is being heated by the water heater 10. When the temperature in the building rises to the predetermined value, the thermostat 100 operates to switch off the circulating pump 76, the immersion heaters in the water heater 10 and the circulating fan 90. The water heater 10 may be clearly used in more complex systems of this kind as a person skilled in the art will readily appreciate.

As mentioned earlier, there are many other possible uses for a water heater in accordance with the present invention, for example as a booster to raise a hot water temperature for specific purposes, to maintain a required water temperature in long runs in an industrial installation, or to ensure adequately hot water at the upper levels of a high building.

Other uses of the invention and other embodiments of the water heater of the invention will be apparent to a person skilled in the art, the scope of the invention being defined in the appended claims.

What I claim as new and desire to protect by Letters Patent of the United States is:

1. An electric water heater having an inlet, an outlet and a series of consecutive pipe sections in a zig-zag configuration through which water successively flows in passing from the inlet to the outlet, the zig-zag configuration being such that, when the heater is in use with the pipe sections one above the other, each pipe section is upwardly inclined to the horizontal at an acute angle of at least about 30 degrees such that water flows in an upwardly inclined direction through each pipe section, each pipe section having a first end, a second open end and a side wall with an opening adjacent to the first end, each pipe section having a unitary tubular member fitted thereon adjacent said first end, said tubular member having a lateral tubular extension communicating with said side wall opening, each pipe section having an electric immersion heater therein extending longitudinally of the pipe section from the first end thereof and past which water passing through the pipe section flows, said tubular member supporting the immersion heater at said first end, the lateral tubular extension of the tubular member on the first pipe section in the series being connected to one of said inlet and outlet, the second open end of each pipe section in the series other than the last being connected to the lateral tubular extension of the tubular member on the next pipe section in the series, and the second open end of the last pipe section in the series being connected to the other of said inlet and outlet.

2. An electric water heater according to claim 1 wherein, in use, each pipe section is upwardly inclined at an angle in the range of from about 30° to about 75° to the horizontal.

3. An electric water heater according to claim 2 wherein, in use, each pipe section is upwardly inclined at an angle of about 45° to the horizontal.

4. An electric water heater according to claim 1 wherein the pipe sections are disposed in a common vertical plane.

5. A hot water installation including an electric water heater having an inlet and an outlet, a circulating pump operable to pump water through the water heater from the inlet to the outlet, said water heater also comprising a series of consecutive pipe sections in an upright zig-zag configuration through which water successively flows in passing from the inlet to the outlet, each pipe section being upwardly inclined to the horizontal at an acute angle of at least about 30 degrees such that water flows in an upwardly inclined direction through each pipe section, each pipe section having a first end, a second open end and a side wall with an opening adjacent to the first end, each pipe section having a unitary tubular member fitted thereon adjacent said first end, said tubular member having a lateral tubular extension communicating with said side wall opening, each pipe section having an electric immersion heater therein extending longitudinally of the pipe section from the first end thereof and past which water passing through the pipe section flows, said tubular member supporting the immersion heater at said first end, the lateral tubular extension of the tubular member on the first pipe section in the series being connected to one of said inlet inlet and outlet, the second open end of each pipe section in the series other than the last being connected to the lateral tubular extension of the tubular member on the next pipe section in the series, and the second open end of the last pipe section in the series being connected to the other of said inlet and outlet, and means for energizing and de-energizing the immersion heaters.

6. A hot water installation according to claim 5 wherein each pipe section is upwardly inclined at an angle in the range of from about 30° to about 75° to the horizontal.

7. A hot water installation according to claim 6 wherein each pipe section is upwardly inclined at an angle of about 45° to the horizontal.

8. A hot water installation according to claim 5 wherein the pipe sections are disposed in a common vertical plane.

* * * * *